US009897951B2

(12) United States Patent
Ju

(10) Patent No.: US 9,897,951 B2
(45) Date of Patent: Feb. 20, 2018

(54) IMAGE FORMING APPARATUS AND CONTROL METHOD FOR THE SAME

(71) Applicant: S-PRINTING SOLUTION CO., LTD., Suwon-si (KR)

(72) Inventor: Jeong Yong Ju, Suwon-si (KR)

(73) Assignee: S-PRINTING SOLUTION CO., LTD., Suwon-si (KR)

( * ) Notice: Subject to any disclaimer, the term of this patent is extended or adjusted under 35 U.S.C. 154(b) by 0 days.

(21) Appl. No.: 14/960,762

(22) Filed: Dec. 7, 2015

(65) Prior Publication Data

US 2016/0357133 A1 Dec. 8, 2016

(30) Foreign Application Priority Data

Jun. 5, 2015 (KR) ..... 10-2015-0079798

(51) Int. Cl.
*G03G 15/00* (2006.01)
*G03G 15/20* (2006.01)

(52) U.S. Cl.
CPC ..... *G03G 15/2028* (2013.01); *G03G 15/657* (2013.01); *G03G 2215/00675* (2013.01)

(58) Field of Classification Search
CPC ..... G03G 15/2028
USPC ..... 399/400
See application file for complete search history.

(56) References Cited

U.S. PATENT DOCUMENTS 5,722,012 A * 2/1998 Saitoh ..... G03G 15/2064 399/400
2003/0190175 A1* 10/2003 Pitts ..... G03G 15/2028 399/322
2005/0207802 A1 9/2005 Izumi et al.
2007/0098472 A1* 5/2007 Saeki ..... G03G 15/657 399/400
2009/0067909 A1 3/2009 Kim et al.
2009/0129831 A1* 5/2009 Sakashita ..... G03G 15/657 399/309
2009/0148212 A1* 6/2009 Himeno ..... G03G 15/2028 399/400
2009/0324311 A1* 12/2009 Matsumoto ..... B65H 5/36 399/400
2010/0061741 A1 3/2010 Minbu
2010/0303487 A1* 12/2010 Miyakawa ..... G03G 15/657 399/44

(Continued)

FOREIGN PATENT DOCUMENTS

EP 1 353 243 10/2003

OTHER PUBLICATIONS

Extended European Search Reported dated Nov. 9, 2016 in corresponding European Patent Application No. 15 199 209.6.

*Primary Examiner* — Anthony Nguyen
(74) *Attorney, Agent, or Firm* — Staas & Halsey LLP

(57) ABSTRACT

An image forming apparatus and a control method are provided. The image forming apparatus includes fusing rollers that fuse a developer at a printing medium, and a transporting guide that guides the printing medium being transported toward the fusing rollers. The transporting guide is movably installed to move between a first position to guide the printing medium, and a second position spaced apart from the first position. Thus, a friction between the transporting guide and the printing medium as well as the subsequent generation of static electricity may be reduced.

25 Claims, 8 Drawing Sheets

(56) References Cited

U.S. PATENT DOCUMENTS

| | | | | |
|---|---|---|---|---|
| 2011/0064451 | A1* | 3/2011 | Yamaguchi | G03G 15/2028 399/99 |
| 2011/0200345 | A1* | 8/2011 | Takahashi | G03G 15/1605 399/45 |
| 2012/0230746 | A1* | 9/2012 | Namisaki | G03G 15/2028 399/400 |
| 2013/0004222 | A1* | 1/2013 | Sakaya | B65H 5/062 399/400 |
| 2014/0126945 | A1 | 5/2014 | Uchida et al. | |

* cited by examiner

IMAGE FORMING APPARATUS AND CONTROL METHOD FOR THE SAME

CROSS-REFERENCE TO RELATED APPLICATIONS

This application is related to, and claims the priority benefit of, Korean Patent Application No. 10-2015-0079798, filed on Jun. 5, 2015, in the Korean Intellectual Property Office, the disclosure of which is incorporated herein by reference.

BACKGROUND

1. Field

Embodiments of the present disclosure relate to an image forming apparatus having a transporting guide that guides a printing medium between a transferring apparatus and a fusing unit, and a control method thereof.

2. Description of the Related Art

In general, an image forming apparatus is an apparatus configured that forms images on a printing medium, and includes a printer, a photocopying apparatus, a facsimile, and a multi-function apparatus combined and implemented the functions of the printer, the photocopying apparatus, and the facsimile.

The image forming apparatus as such includes a plurality of developing apparatuses to develop an electrostatic latent image into a visible image by use of a developer, a light scanning apparatus that forms an electrostatic latent image on a surface of a photoreceptor by radiating light at the photoreceptor of the developing apparatus, a transferring apparatus to transfer the visible image developed at the photoreceptor to printing medium, and a fusing unit that fuses the photoreceptor on the printing medium.

A transporting guide configured to guide the printing medium having the photoreceptor transferred thereto by use of the transferring apparatus to the fusing unit is disposed between the transferring apparatus and the fusing unit.

The transporting guide that performs a role to guide a front end of the printing medium transferred from the transferring apparatus to the fusing unit may be entered between a heating roller and a pressing roller of the fusing unit.

However, after the front end of the printing medium is entered between the heating roller and the pressing roller of the fusing unit, one side surface of the printing medium facing the transporting guide makes contact with the transporting guide, generating static electricity.

SUMMARY

Therefore, it is an aspect of at least one exemplary embodiment to provide an image forming apparatus capable of reducing static electricity generated from friction between a printing medium transported toward a transferring roller and a transporting guide guiding the printing medium.

It is an aspect of at least one exemplary embodiment to provide an image forming apparatus capable of reducing the contact between a printing medium transported toward a fusing roller and a static removing member.

Additional aspects of the disclosure will be set forth in part in the description which follows and, in part, will be obvious from the description, or may be learned by practice of the disclosure.

In accordance with an aspect of at least one exemplary embodiment, an image forming apparatus includes fusing rollers that fuse a developer at a printing medium, and a transporting guide that guides the printing medium being transported toward the fusing rollers. The transporting guide may be movably installed to move in between a first position provided that guides the printing medium and a second position spaced apart by a certain distance from the first position.

A driving device to move the transporting guide may be included.

The driving device includes a driving motor, a cam rotated by the driving motor and configured to move the transporting guide in a first direction, and an elastic member to elastically support the transporting guide in a second direction opposite the first direction.

The driving device includes a driving axis rotated by use of the driving motor, the cam is provided as a pair of cams, each of the pair of cams installed at a respective side of the driving axis, and the transporting guide may include a pair of supporting portions, each of the pair of supporting portions provided at a respective side of the transporting guide as to correspond to the each of the pair of cams.

The driving device includes a driving motor, a pinion rotated by use of the driving motor, and a rack teeth-coupled to the pinion while disposed at the transporting guide.

The driving device includes a driving axis rotated by use of the driving motor, the pinion is provided as a pair of pinions, each of the pair of pinions respectively installed at a side of the driving axis, and the rack is provided as a pair of racks, each of the racks of the pair of racks respectively disposed at a side of the transporting guide as to correspond to the respective each of the pair of pinions.

The transporting guide is positioned at the first position before the front end of the printing medium has entered in between the pair of fusing rollers, and is moved from the first position to the second position when the front end of the printing medium has entered in between the pair of the fusing rollers.

The apparatus includes a static removing member that removes static electricity of the printing medium being transported toward the fusing rollers is. The static removing member moves along with the transporting guide.

The static removing member is positioned at the first position before the front end of the printing medium has entered in between the pair of fusing rollers, and is moved from the first position to the second position when the front end of the printing medium has entered in between the pair of the fusing rollers.

In accordance with an aspect of at least one exemplary embodiment, an image forming apparatus includes a body, a developing unit that develops an electrostatic latent image to a visible image, a transferring apparatus that transfers the visible image of the developing unit to a printing medium, a fusing unit that fuses the visible image transferred to the printing medium, and a static removing member that removes the static electricity of the printing medium being transported from the transferring apparatus to the fusing unit, and the static removing member while movably installed at an inside the body moves in between a first position and a second position spaced apart from the first position.

In accordance with an aspect of at least one exemplary embodiment, an image forming apparatus includes a body, a developing unit that develops an electrostatic latent image to a visible image, a transferring apparatus that transfers the visible image of the developing unit to a printing medium, a fusing unit that fuses the visible image transferred to the printing medium, a transporting guide movably installed at an inside the body that guides the printing medium from the transferring apparatus to the fusing unit, and a driving device that moves the transporting guide.

In accordance with an aspect of at least one exemplary embodiment, a control method of an image forming apparatus includes confirming of a position of a printing medium being transported toward a position in between rollers, maintaining of a state of a transporting guide positioned at a first position, upon confirming that the front end of the printing medium has not entered in between the pair of fusing rollers, and moving of the transporting guide from the first position to a second position spaced apart from the first position toward one side of the first direction, upon confirming that the position of the front end of the printing medium is entered in between the fusing rollers.

In accordance with at least one exemplary embodiment, upon confirming that the position of a rear end of the printing medium has not passed through the transferring roller, the transporting guide maintains a state of being positioned at the second position, and upon confirming that the position of the rear end of the printing medium has passed through the transferring roller, the transporting guide is moved from the second position to the first position.

An image forming apparatus in accordance with at least one exemplary embodiment, including a transporting guide positioned at a first position when guiding a front end of a printing medium, and moved to a second position spaced apart from the first position after the front end of the printing medium has entered in between fusing rollers, reduces friction and reduces subsequent static electricity between the printing medium and the transporting guide.

An image forming apparatus in accordance with an embodiment of at least one exemplary embodiment includes a static removing member that removes static electricity formed at a printing medium movably installed thereto, and contact between the static removing member and the printing medium can be reduced

BRIEF DESCRIPTION OF THE DRAWINGS

These and/or other aspects of the disclosure will become apparent and more readily appreciated from the following description of the embodiments, taken in conjunction with the accompanying drawings.

DETAILED DESCRIPTION

Figure 1:
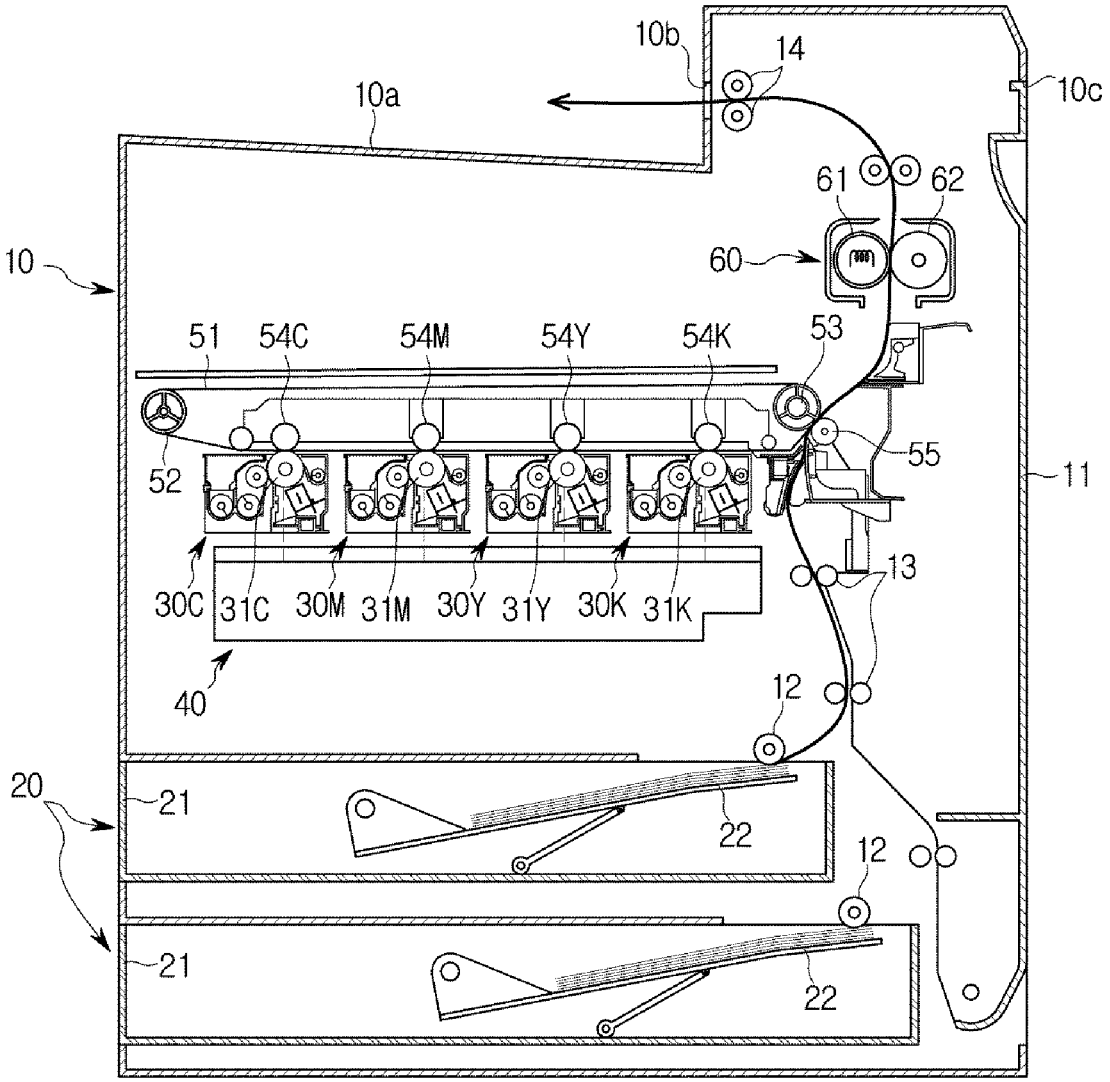
FIG. 1 is a schematic view of an image forming apparatus according to at least one exemplary embodiment.

Reference will now be made in detail to the embodiments of at least one exemplary embodiment, examples of which are illustrated in the accompanying drawings, wherein like reference numerals refer to like elements throughout.

As illustrated on FIG. 1, an image forming apparatus in accordance with at least one exemplary embodiment includes a body 10 forming an exterior appearance of the image forming apparatus, a printing medium supplying unit 20 provided, for example, at a lower portion of the body 10 and at which printing mediums P to be used at the image forming apparatus in accordance may be stored, a plurality of developing units 30C, 30M, 30Y, and 30K to develop an electrostatic latent image to a visible image by use of different colors through a developer, a light scanning unit 40 that forms an electrostatic latent image at photoreceptors 31C, 31M, 31Y, and 30K of the charged developing units 30C, 30M, 30Y, and 30K by radiating light, developing units 30C, 30M, 30Y, and 30K that radiates the visible image formed at the photoreceptors 31C, 31M, 31Y, and 31K at the printing medium P (see, for example, FIG. 4) delivered from the printing medium supplying unit 20, and a fusing unit 60 that fuses the developer transferred to printing medium P to the printing medium P.

The body 10 may be provided with a loading unit 10*a* at an upper portion thereof. A side of the loading unit 10*a* may be provided with a paper discharging unit 10*b* through which a printing medium P, for example having completed with a formation of an image, may be discharged. An opening 10*c* may be provided at a side, e.g., one side of the body 10 so, for example, repairing or changing components or replacing consumable items at an inside of the body 10 may be performed. A cover 11 may be installed at the a side, e.g., one side of the body 10 to open/close the opening 10*c*. A lower end of the cover 11 may be rotatively installed at the body 10 to open/close the opening 10*c* while rotating with respect to the lower end as a center.

The printing medium supplying unit 20 includes a printing medium cartridge 21 that may be formed in the shape of a drawer and may be movably installed at the body 10. A knock-up plate 22 may be disposed at an inside of the printing medium cartridge 21 and at which the printing medium P may be loaded. The printing medium supplying unit 20 at least one exemplary embodiment is vertically provided in two units.

The developing units 30C, 30M, 30Y, and 30K may each include the photoreceptors 31C, 31M, 31Y, and 31K at which an electrostatic latent image is formed by use of the light scanning unit 40. Although not illustrated, the developing units 30C, 30M, 30Y, and 30K may each include a developing roller to supply a developer, and a charging roller to charge the photoreceptors 31C, 31M, 31Y, and 31K.

The developing units 30C, 30M, 30Y, and 30K according to at least one exemplary embodiment include four units of developing units 30C, 30M, 30Y, and 30K each provided with the certain one developer having one of the colors such as Cyan C, Magenta M, Yellow Y, and Black K stored at an inside thereof, and the developing units 30C, 30M, 30Y, and 30K each may develop the one of the colors of Cyan C, Magenta M, Yellow Y, and Black K. The four units of developing units 30C, 30M, 30Y, and 30K may be evenly disposed at lower sides of the developing units 30C, 30M, 30Y, and 30K.

The light scanning unit 40 may form an electrostatic latent image on the surface of the each of the photoreceptors 31C, 31M, 31Y, and 31K by radiating the light provided with image information at the photoreceptors 31C, 31M, 31Y, and 31K provided at the developing units 30C, 30M, 30Y, and 30K, respectively.

Figure 2:
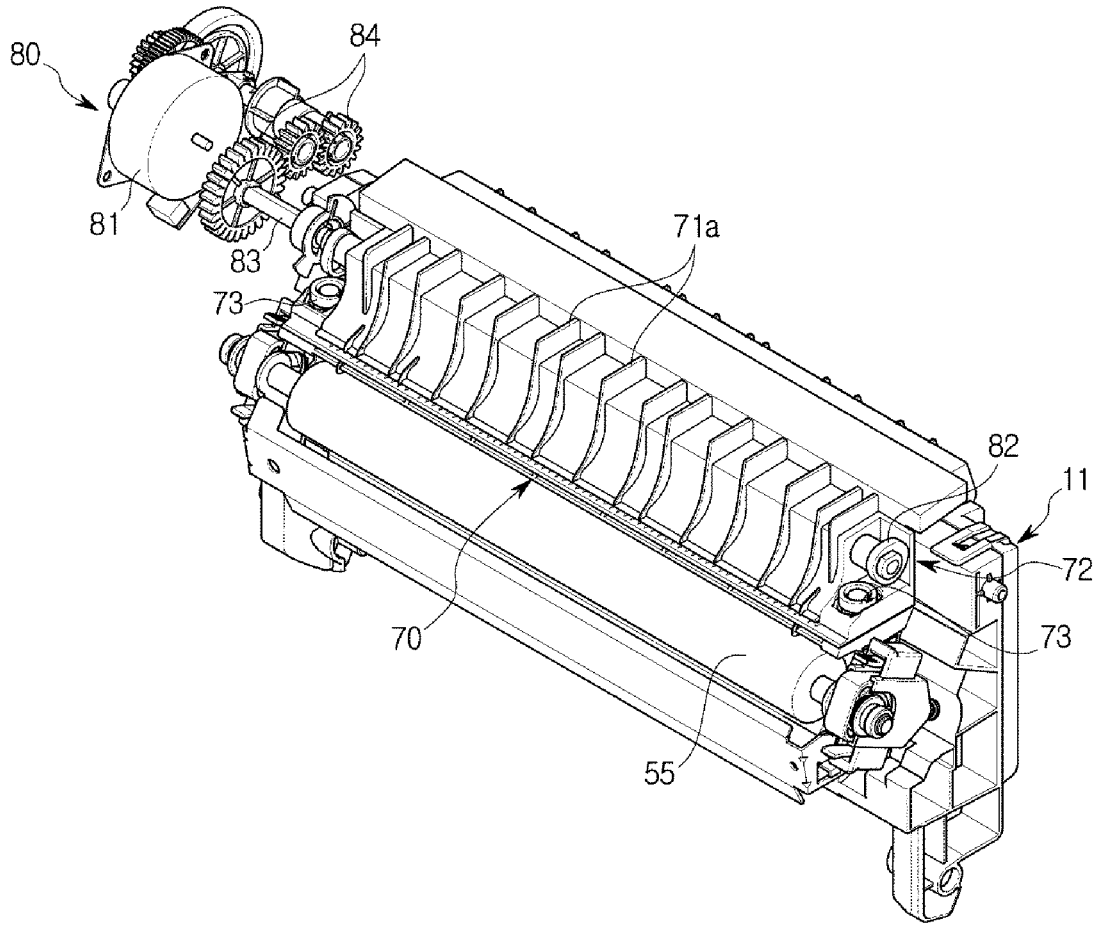
FIG. 2 is a perspective view of a transporting guide according to at least one exemplary embodiment.

As illustrated on FIGS. 1-2, the developing units 30C, 30M, 30Y, and 30K may include a middle transferring belt 51 at which the each developer is developed while overlapped as visible images at the photoreceptors 31C, 31M, 31Y, and 31K, and a driving roller 52 and a passive roller 53 disposed at inside of the middle transferring belt 51 as to rotate the middle transferring belt 51.

A transferring apparatus 50 includes transferring rollers 54 and 55 to transfer the developer. The transferring rollers 54 and 55 includes first transferring rollers 54 each disposed to respectively face each of the photoreceptors 31C, 31M, 31Y, and 31K of the developing units 30C, 30M, 30Y, and 30K in a state that the middle transferring belt 51 is interpositioned therein between as to transfer the visible images of the photoreceptors 31C, 31M, 31Y, and 31K are transferred to the middle transferring belt 51. A second transferring roller 55 may be disposed to face the passive roller 53 in a state that the middle transferring belt 51 is interpositioned, for example, in between the second transferring roller 55 and the passive roller 53 as to have the visible images of the middle transferring belt 51 transferred to the printing medium P.

The second transferring roller 55 according to an exemplary embodiment may be installed at an inner side of the cover 11. The cover 11 includes a supporting frame 15 (see, for example, FIG. 3) provided at an inner side of the cover 11 that supports the second transferring roller 55 and a transporting guide 70.

The fusing unit 60 includes a plurality of fusing rollers, e.g., a pair of fusing rollers 61 and 62 to apply heat and pressure at the printing medium P having transferred with the developer. The fusing rollers 61 and 62 include a heating roller 61 to generate heat, and a pressing roller 62 provided with an outer circumferential surface thereof formed with elastically deformable material and to press the printing medium P at the outer circumferential surface of the heating roller 61, for example.

A lower portion of the body 10 includes a pick-up roller 12 disposed at an upper portion of one side of the printing medium supplying unit 20 to pick up the printing mediums P loaded at an inside of the printing medium supplying unit 20, for example, one-by-one, and a transporting roller 13 that guides the printing medium P picked up by the pick-up roller 12 to the transferring apparatus 50.

An upper portion of the body 10 may include a pair of rollers 14, to discharge the printing medium P passed through the fusing unit 60 through the paper discharging unit 10*b*, disposed at an inner side of the paper discharging unit 10*b*.

An inside of the body 10 may include the transporting guide 70 disposed in between the second transferring roller 55 and the fusing rollers 61 and 62. The transporting guide 70 may guide the printing medium P, e.g., the front end of the printing medium toward a position between the fusing rollers 61 and 62 while the printing medium P is provided with the developer transferred thereto while passing through the second transferring roller 55.

Figure 3:
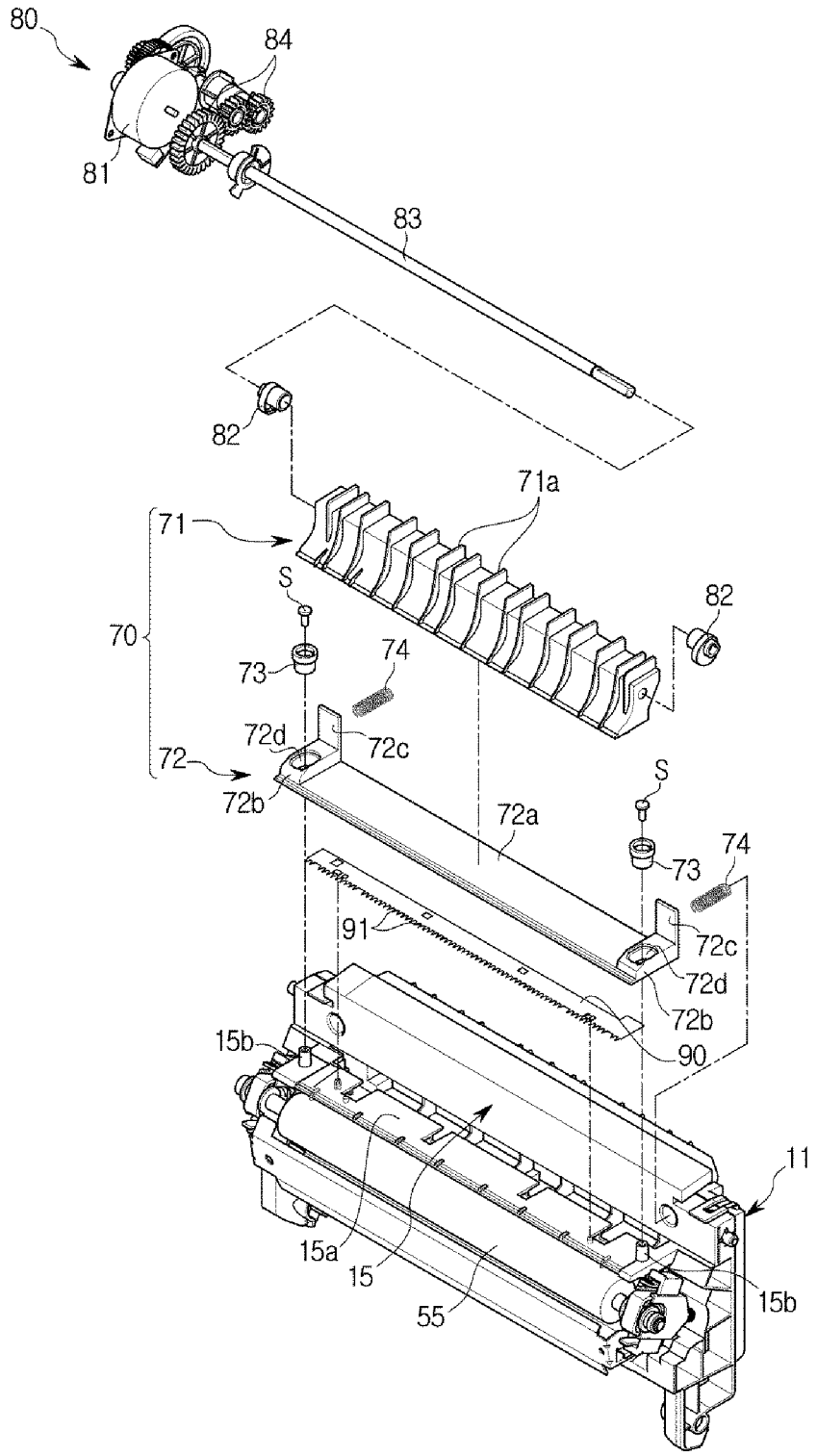
FIG. 3 is an exploded perspective view of the transporting guide and a driving device according at least one exemplary embodiment.

As illustrated in FIG. 2 and FIG. 3, the transporting guide 70 may be movably installed at an inside of the body 10. The inside of the body 10 may be provided with a sensor (not illustrated) that detects a position of the printing medium, e.g., a front end and a rear end of the printing medium P. A driving device 80 may generate a driving force that moves the transporting guide 70, such that the transporting guide 70 may be moved by driving the driving device 80 according to the position of the printing medium P detected through the sensor.

The transporting guide 70 may move between a first position (see, for example, FIG. 4) that guides the front end of the printing medium P and a second position (see, for example, FIG. 5) spaced apart by a certain distance from the first position to reduce contact with respect to the printing medium P. That is, the transporting guide 70 may guide the front end of the printing medium P at the first position. According to an embodiment, in a case when there is no need to guide the front end of the printing medium P, e.g., as the front end of the printing medium P is entered in between the fusing rollers 61 and 62, the transporting guide 70 may move to the second position, e.g., to reduce the friction between the transporting guide 70 and the printing medium P.

According to at least embodiment, the transporting guide 70 includes a guide member 71 that guides the printing medium P while making contact with the printing medium P being transported toward the fusing unit 60, and a moving member 72 movably installed at an inside of the body 10. The guide member 71 may be coupled to an upper side of the moving member 72, and move along the moving member 72.

The guide member 71 may be extended in a vertical direction, and include a plurality of guide ribs 71*a* distantly and parallelly disposed with respect to each other in a horizontal direction, and may guide the printing medium P toward an upper side.

According to at least one exemplary embodiment, the moving member 72 includes a coupling portion 72*a* provided with the guide unit 71 coupled to an upper side thereof, a pair of guide units 72*b* provided at sides of the coupling portion 72*a* and movably installed at an inside of the body 10 to guide the moving member 72, and a pair of supporting portions 72*c* supported at a cam surface of a cam 82 of the driving device 80.

According to at least one exemplary embodiment, the two guide units 72*b* are each provided with a guide hole 72*d* horizontally extended in a moving direction of the transporting guide 70. The supporting frame 15 includes a fusing unit 15*a* at which the transporting guide is movably fused, and a guide protrusion 15*b* protruded toward an upper side from the fusing unit 15*a* and penetrating through the guide hole 72*d*. The two guide protrusion 15*b* may each be provided with a guide bush 73 installed thereto by use of a coupling member S such as a screw, and the moving member 72 may maintain a state of being movably installed through the guide bush 73 at the supporting frame 15.

The supporting portion 72*c* may be formed from one side of the guide unit 72*b* toward the surface extended in a perpendicular direction, and reciprocally interact with respect to the cam 82.

The driving device 80 includes a driving motor 81 that generates a rotational force, the pair of cams 82 their rotate by receiving the rotational force from the driving motor 81, a driving axis 83 provided with the two cams 82 installed at sides thereof, and a plurality of gears 84 that may be disposed between the driving motor 81 and the driving axis 83, e.g., to decelerate the speed. The driving device 80 includes a plurality of, e.g., a pair of elastic members 74 configured such that the transporting guide 70 moved by use of the cam 82 may be returned to an original position while supporting the transporting guide 70.

The two cams 82 may each include a cam surface gradually changed while the radius of the outer circumferential surface thereof proceeds toward a radial direction. The cam surfaces of the two cams 82 may each be supported at one surface of the each of the supporting portions 72*c*, and the two elastic members 74 may be installed at the supporting frame 15 as to support the opposite surfaces of the supporting portions 72*c*.

Figure 4:
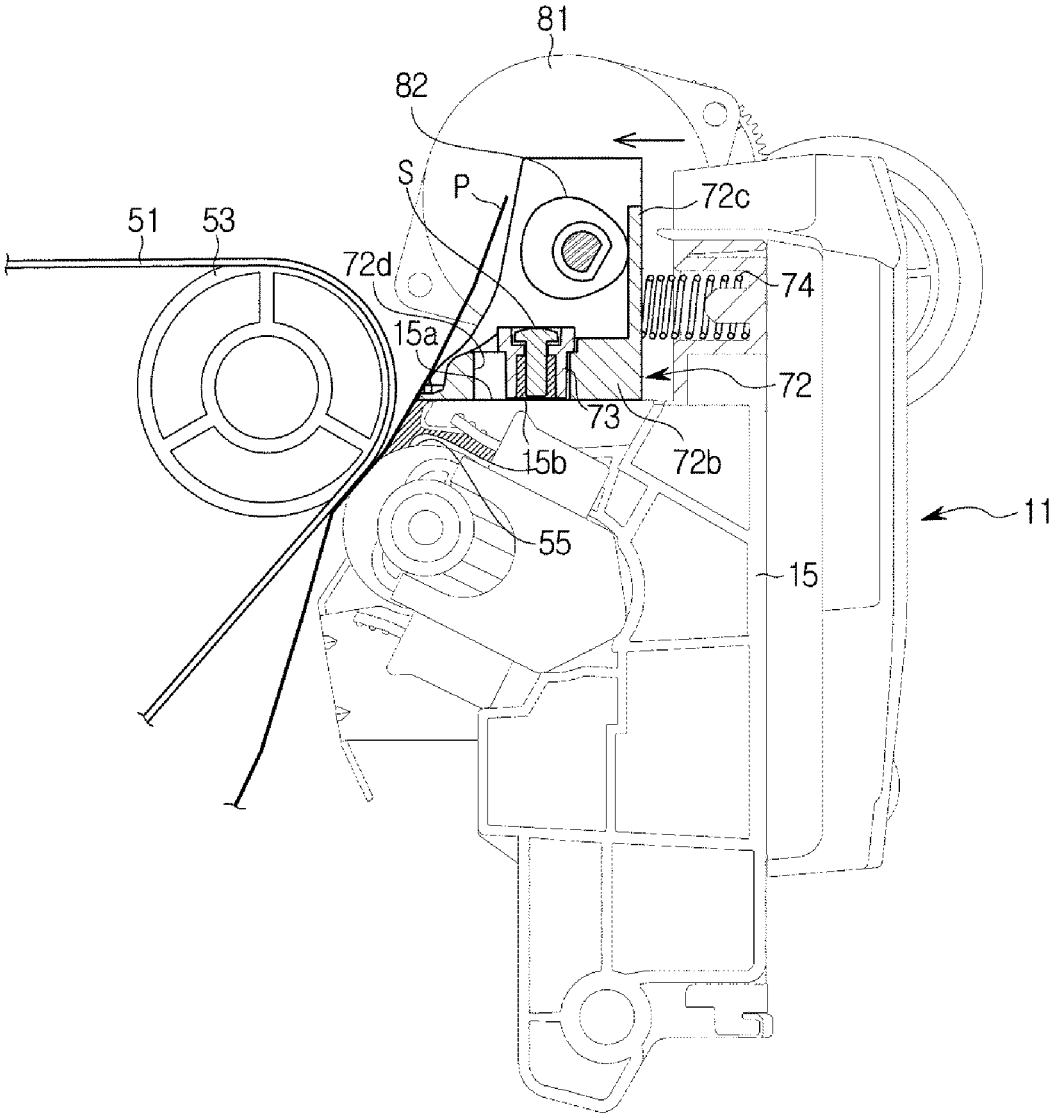
FIG. 4 and FIG. 5 are side views illustrating motions of the transporting guide and the driving device according to the first embodiment of at least one exemplary embodiment.
Figure 5:
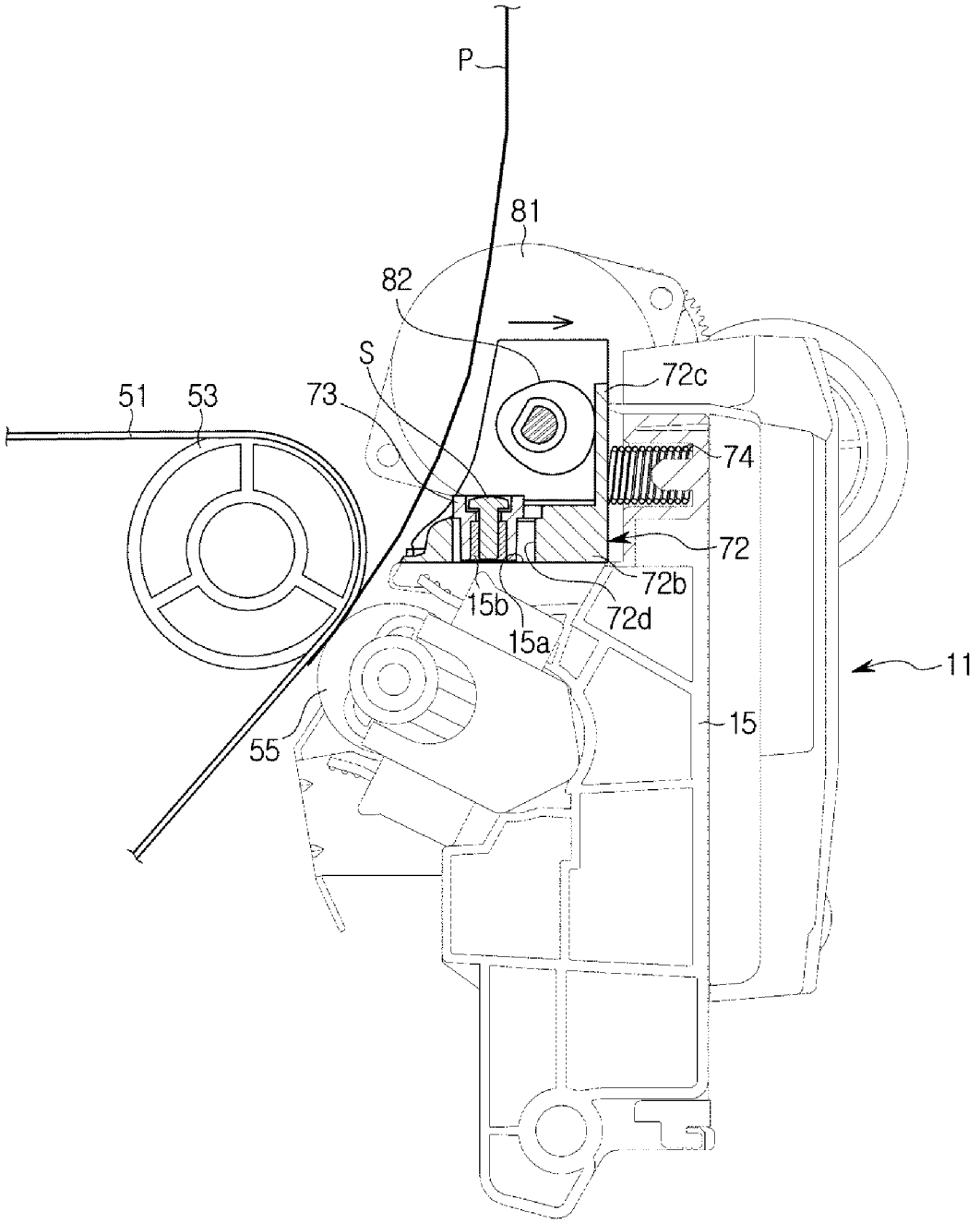

Thus, as illustrated in FIG. 4, when the cams 82 are rotated by a certain degree in a single direction so the transporting guide 70 are positioned at a first position, a force may be delivered to the supporting portions 72*c* through the cams 82, and accordingly, the transporting guide 70 may be moved toward a first direction as the elastic members 74 are elastically deformed. As illustrated in FIG. 5, the transporting guide 70 may be moved to a second position. When the cams 82 are again rotated by a certain degree, the force being applied to the supporting portions 72*c* through the cams 82 may be released, and accordingly, the transporting guide 70 may be moved toward a second direction, which is an opposite direction to the first direction, as the elastic members 74 are elastically restored, and as illustrated on FIG. 5, the transporting guide 70 is moved again to the first position.

The first position of the transporting guide 70 is referred to as a position to transport the front end of the printing medium P toward a position in between the two fusing rollers 61 and 62, and the second position of the transporting guide 70 may be referred to as a position to reduce the friction in between the transporting guide 70 and the printing medium P.

A lower side of the transporting guide 70 may be provided with a static removing member 90 configured to remove static electricity The static removing member 90 may move toward the first position and the second position along with the transporting guide 70. The static removing member 90 may be formed in the shape of a rectangular plate. A static removing portion 91 having the shape of a saw tooth may be provided at one side end of the static removing member 90 while the static removing portion 91 may be provided to face one side surface of the printing medium P being delivered from the transferring apparatus 50 to the fusing unit 60.

Exemplary motions of the image forming apparatus are described by referring to the drawings.

Referring to FIG. 1, the charged photoreceptors 31C, 31M, 31Y, and 31K may be provided with an electrostatic latent image formed thereto by the light radiated from the light scanning unit 40. The charged photoreceptors 31C, 31M, 31Y, and 31K having formed with the electrostatic latent image is supplied with the developers by use of the developing roller. Therefore, the electrostatic latent images are developed into a visible image by use of the developers.

The visible images developed at the photoreceptors 31C, 31M, 31Y, and 31K by use of the developers may be overlappingly transferred to the transferring belt 51, and the visible image formed by being overlappingly transferred is transferred to the printing medium P by use of the second transferring roller 55.

The printing medium P at which the developers are transferred while passing in between the second transferring roller 55 and the transferring belt 51 may be delivered by use of the transporting guide 70 to the position in between of the heating roller 61 and the pressing roller 62 of the fusing unit 60. The developers transferred to the printing medium P may be fused at the printing medium P by use of the heat and pressure applied by use of the heating roller 61 and the pressing roller 62 of the fusing unit 60.

After passing through the second transferring roller 55, at least a part of the printing medium, e.g., the front end of the printing medium P is guided to the position in between of the heating roller 61 and the pressing roller 62 by use of the transporting guide 70 positioned at the first position.

A confirmation may be made if the front end of the printing medium P is entered into the position in between of the two fusing rollers 61 and 62 of the fusing unit 60. Prior to the front end of the printing medium P entering into the position in between of the two fusing rollers 61 and 62, the transporting guide 70, as illustrated on FIG. 4, may be maintained in a state of being positioned at the first position.

Upon confirming that the front end of the printing medium P is entered in between of the two fusing rollers 61 and 62 of the fusing unit 60, power may be authorized at the driving motor 81 and a rotational force may be generated at the driving motor 81, and the rotational force generated at the driving motor 81 may be delivered to the cams 82 through the driving axis 83 so that the cams 82 may be rotated, for example, by about 180° in a single direction. The portion having a relatively larger radius on the outer circumferential surface of the cam 82 following the rotation of the cam 82 may be supported at one surface of the supporting portion 72*c*, and accordingly, the moving member 72 and the guide member 71 installed at the moving member 72 may be moved from the first position to the second position, as illustrated on FIG. 5, while the elastic member 74 is deformed.

After the transporting guide 70 is moved to the second position, upon confirming that the rear end of the printing medium P is passed through the second transferring roller 55 of the transferring apparatus 50, the transporting guide 70 may maintain a state of being positioned at the second position, for example, until the rear end of the printing medium P is passed through the second transferring roller 55 of the transferring apparatus 50.

Upon confirming that the rear end of the printing medium P is passed through the second transferring roller 55 of the transferring apparatus 50, power may be again authorized at the driving motor 81 and a rotational force is generated. The rotational force generated at the driving motor 81 may be delivered to the cams 82 through the driving axis 83 so that the cams 82 are rotated again by about 180° in a single direction.

The portion having a relatively smaller radius on the outer circumferential surface of the cam 82 following the rotation of the cam 82 may be supported at one surface of the supporting portion 72*c*, and accordingly, as the force applied to the supporting portion 72*c* is released, the moving member 72 and the guide member 71 installed at the moving member 72 may be moved from the second position to the first position, as illustrated on FIG. 4, by the use of the elastic restoring force of the elastic member 74.

The static removing member 90 installed at the transporting guide 70 may also be moved along with the transporting guide 70. That is, the static removing member 90 may be positioned at the first position until the front end of the printing medium P has entered in between the fusing rollers 61 and 62, and when the front end of the printing medium P has entered in between the fusing rollers 61 and 62, the static removing member 90 may be moved to the second position. After the rear end of the printing medium P is passed through the second transferring roller 55, the static removing member 90 may be moved from the second position to the first position again.

As the static removing member 90 may move according to the position of the printing medium P, the static removing portion 91 of the static removing member 90 may be prevented from making contact with one side surface of the printing medium P, and accordingly, a decrease in the quality of image that may be generated in a case when the static removing portion 91 makes contact with the printing medium P may be reduced.

Figure 6:
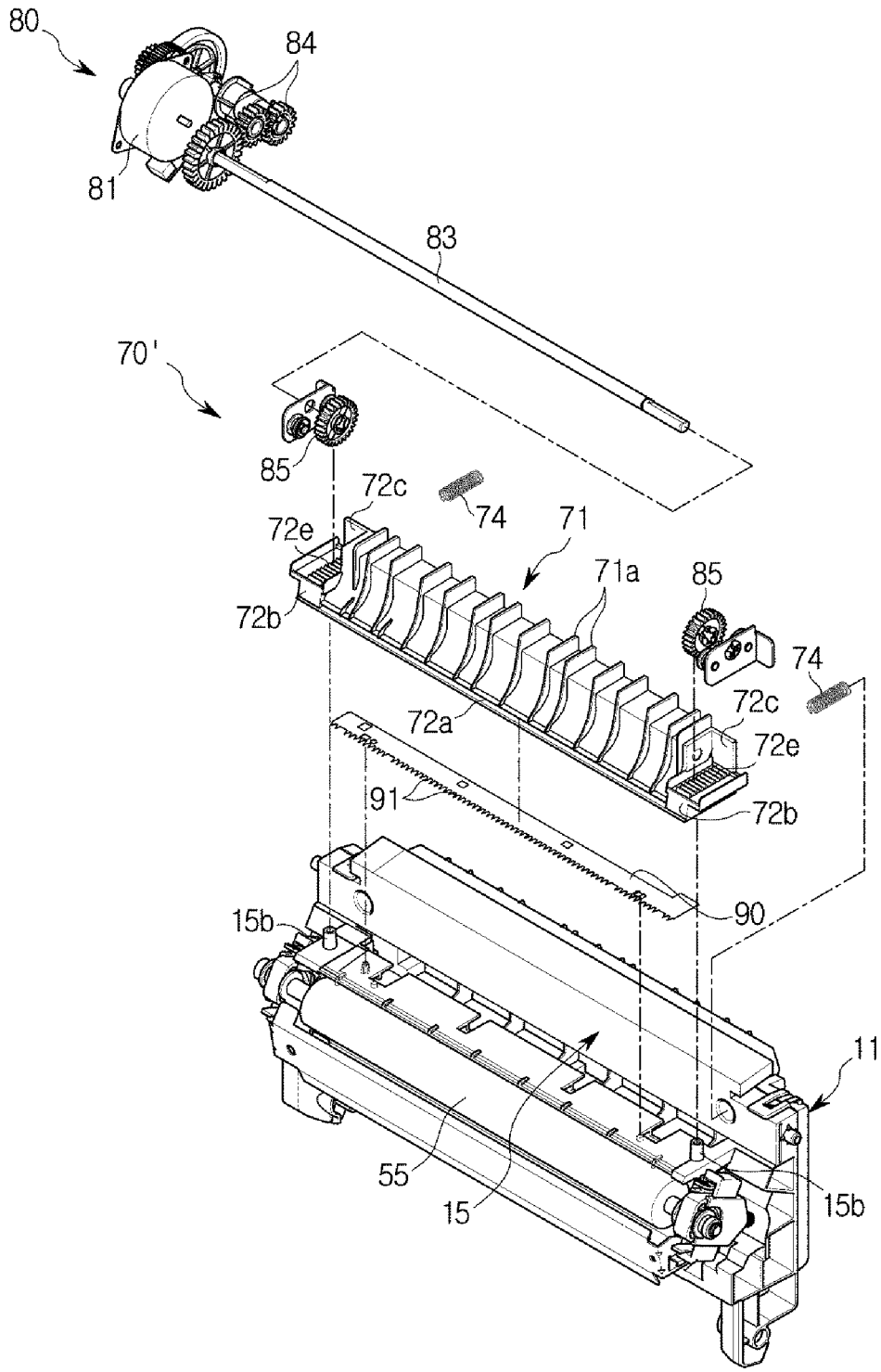
FIG. 6 is an exploded perspective view of a transporting guide and a driving device according to at least one exemplary embodiment.

According to at least one exemplary embodiment, the driving device 80 configured to move the transporting guide 70 includes the cams 82 and the elastic member 74, but is not limited hereto According to at least one embodiment, as illustrated in FIG. 6, a transporting guide 70' may include a pair of pinions 85 having a driving axis 83 provided with the driving device 80 installed at an each side thereof, and a pair of racks 72*e* disposed at each of the both sides of the moving member 72 as to correspond with the pair of pinions 85 and configured to respectively teeth-coupled to the two pinions 85.

Figure 7:
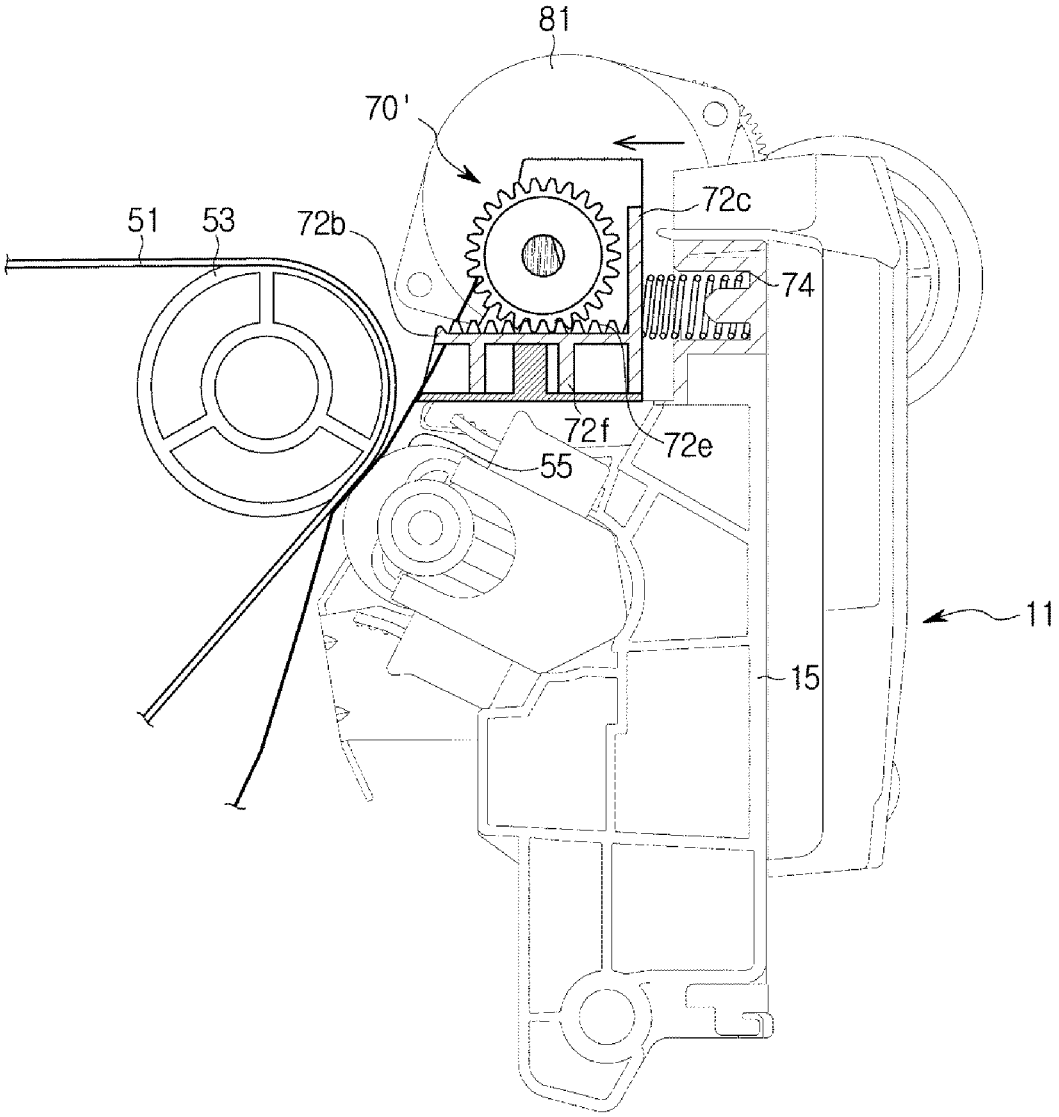
FIG. 7 and FIG. 8 are side views illustrating motions of the transporting guide and the driving device according to at least one exemplary embodiment.
Figure 8:
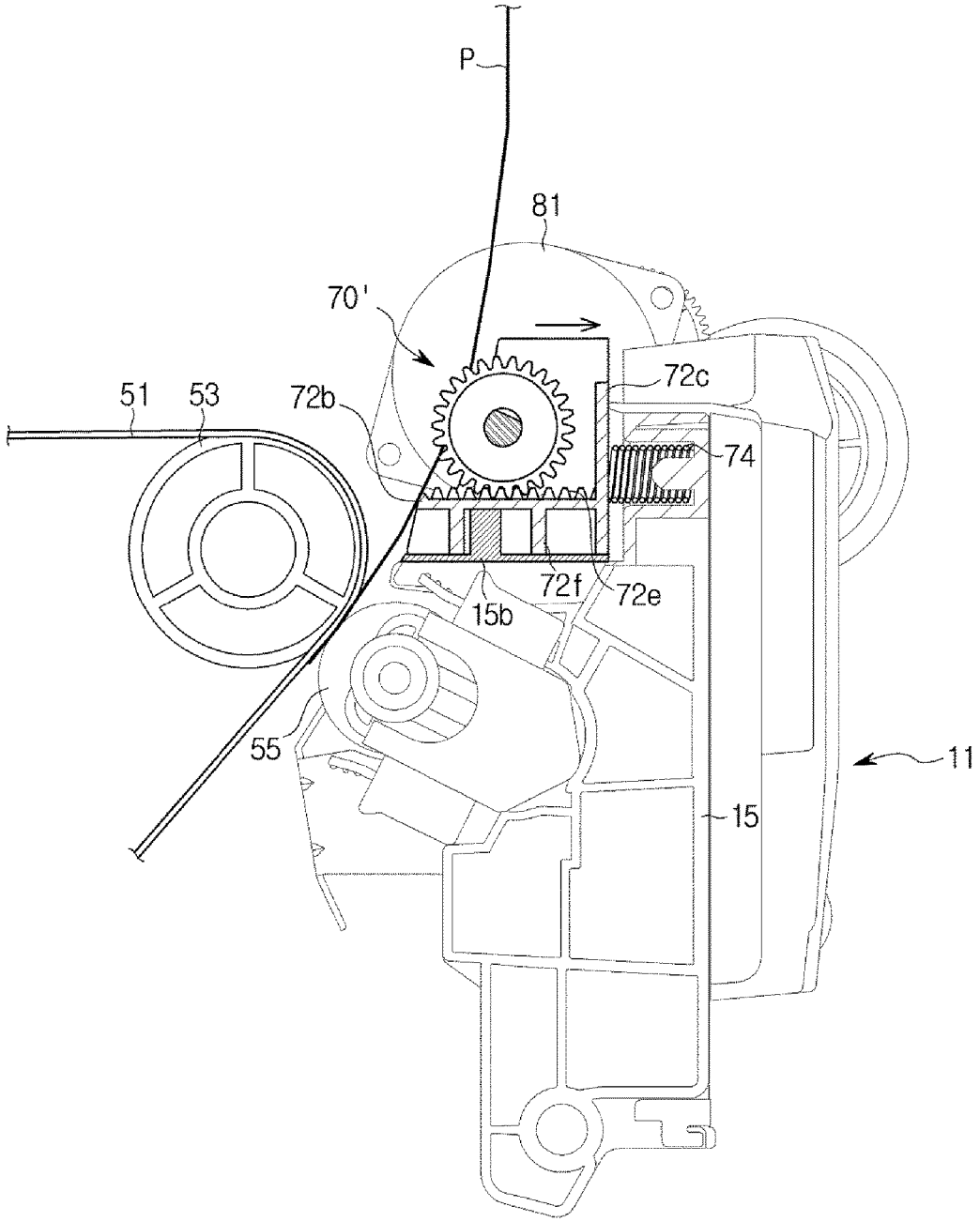

As illustrated on FIG. 7, the image forming apparatus having the driving device 80 as such is provided such that the transporting guide 70' may be moved, as illustrated in FIG. 8, from a first position to a second position, for example, by a rotational force through the racks 72*e* as the driving axis 83 and the pinions 85 coupled to the driving axis 83 are rotated, for example, in a single direction by use of the driving motor 81 in a state that the transporting guide 70' is positioned at the first position, and the transporting guide 70 is returned, as illustrated on FIG. 7, from the second position to the first position by being delivered with rotational force through the racks 72*e* as the driving axis 83 and the pinions 85 are rotated in a reverse direction by use of the driving motor 81.

The driving device 80 according to at least one exemplary embodiment of includes a transporting guide 70 that may be moved through the driving motor. The cams 82 and the elastic member 74, and the driving device 80 according to at least one exemplary embodiment are provided such that the transporting guide 70 may be moved through the driving motor 81, the pinions 85, and the racks 72*e*, but is not limited hereto, and the transporting guide may be moved through various driving devices such as a solenoid.

The static removing member 90 according to at least one exemplary embodiment may be moved along the transporting guide 70 while installed at the transporting guide 70, but is not limited hereto, and the static removing member 90 may be moved independently as the static removing member 90 may be separately structured from the transporting guide 70.

The guide member 71 and the moving member 72 in the above embodiments are separately manufactured and then coupled to each other, but are not limited hereto, and the guide member 71 and the moving member 72 may be provided to be manufactured as a single member.

According to at least one exemplary embodiment, the image forming apparatus includes a separate driving device configured to move the transporting guide 70, but is not limited hereto, and the image forming apparatus may be delivered with driving force from another structure of the image forming apparatus, such as a driving device configured to drive a structure, for example, a developing unit, a transferring unit, or a fusing unit, so that the transporting guide may be moved.

The transferring apparatus in the present embodiment includes the middle transferring belt, the first transferring roller, and the second transferring roller, but is not limited hereto, and the movable transporting guide of at least one exemplary embodiment may be applied as it is to an image forming apparatus having a single transferring roller provided with the transferring apparatus installed while facing a photoreceptor without the structures corresponding to the middle transferring belt and the first transferring roller.

Although a few embodiments of at least one exemplary embodiment have been illustrated and described, it would be appreciated by those skilled in the art that changes may be made in these embodiments without departing from the principles and spirit of the disclosure, the scope of which is defined in the claims and their equivalents.

What is claimed is:

1. An image forming apparatus, comprising:
a plurality of fusing rollers that fuse a developer at a printing medium; and
a transporting guide that guides the printing medium being transported toward the plurality of fusing rollers,
wherein the transporting guide is linearly movably installed to move between a first position to guide at least a part of the printing medium, and a second position spaced apart by a predetermined distance from the first position.

2. The image forming apparatus of claim 1, further comprising:
a driving device that moves the transporting guide.

3. The image forming apparatus of claim 2, wherein:
the driving device comprises:
a driving motor,
a cam rotated by the driving motor and that moves the transporting guide in a first direction, and
an elastic member that elastically supports the transporting guide in a second direction opposite to the first direction.

4. The image forming apparatus of claim 3, wherein:
the driving device further comprises a driving axis rotated by the driving motor,
wherein the cam is provided as a pair of cams, and each of the pair of cams is installed at a respective side of the driving axis, and
the transporting guide comprises a pair of supporting portions, each of the pair of the supporting portions provided at a respective side of the transporting guide as to correspond to the each of the pair of cams.

5. The image forming apparatus of claim 1, wherein:
the driving device comprises:
a driving motor,
a pinion rotated by the driving motor, and
a rack teeth-coupled to the pinion while disposed at the transporting guide.

6. The image forming apparatus of claim 5, wherein:
the driving device further comprises a driving axis rotated by the driving motor,
the pinion is provided as a pair of pinions, and each of the pair of pinions is installed at a respective side of the driving axis, and
the rack is provided as a pair of racks, and the each of the pair of racks is disposed at a respective side of the transporting guide as to correspond to the each of the pair of pinions.

7. The image forming apparatus of claim 1, wherein:
the transporting guide is positioned at the first position before the front end of the printing medium enters in between the plurality of fusing rollers, and is moved from the first position to the second position when the front end of the printing medium enters in between the plurality of the fusing rollers.

8. The image forming apparatus of claim 1, further comprising:
a static removing member to remove static electricity of the printing medium being transported toward the fusing rollers, and
the static removing member moves along with the transporting guide while installed at the transporting guide.

9. The image forming apparatus of claim 8, wherein:
the static removing member is positioned at the first position before the front end of the printing medium enters in between the plurality of fusing rollers, and is moved from the first position to the second position when the front end of the printing medium enters in between the plurality of the fusing rollers.

10. An image forming apparatus, comprising:

a body;

a developing unit that develops an electrostatic latent image to a visible image;

a transferring apparatus that transfers the visible image of the developing unit to a printing medium;

a fusing unit that fuses the visible image transferred to the printing medium; and a static removing member that removes static electricity of the printing medium being transported from the transferring apparatus to the fusing unit, wherein the static removing member is linearly movably installed at an inside the body so as to move between a first position and second position spaced apart from the first position depending on a position of the printing medium.

11. The image forming apparatus of claim 10, wherein:

the static removing member is positioned at the first position before a front end of the printing medium enters into the fusing unit, and is moved from the first position to the second position when the front end of the printing medium enters into the fusing unit.

12. An image forming apparatus, comprising:

a body;

a developing unit that develops an electrostatic latent image to a visible image, a transferring apparatus that transfers the visible image of the developing unit to a printing medium;

a fusing unit that fuses the visible image transferred to the printing medium;

a transporting guide linearly movably installed at an inside of the body to linearly move between a first position and a second position to guide the printing medium from the transferring apparatus to the fusing unit; and a driving device that moves the transporting guide.

13. The image forming apparatus of claim 12, wherein:

the driving device comprises:

a driving motor, a cam rotated by the driving motor and that moves the transporting guide in a first direction, and an elastic member that elastically supports the transporting guide in a second direction opposite to the first direction.

14. The image forming apparatus of claim 13, wherein:

the driving device further comprises a driving axis rotated by the driving motor, the cam is provided as a pair of cams, each of the cams of the pair of cams respectively installed at a side of the driving axis, and the transporting guide comprises a pair of supporting portions, each of the pair of the supporting portions respectively provided at a side of the transporting guide as to correspond to the each of the pair of cams.

15. The image forming apparatus of claim 12, wherein:

the driving device comprises:

a driving motor, a pinion rotated by the driving motor, and a rack teeth-coupled to the pinion while disposed at the transporting guide.

16. The image forming apparatus of claim 15, wherein:

the driving device further comprises a driving axis rotated by the driving motor, the pinion is provided as a pair of pinions and the each of the pair of pinions is installed at a respective side of the driving axis, and the rack is provided as a pair of racks and the each of the racks of the pair of racks is disposed at a respective side of the transporting guide to correspond to the each of the pair of pinions.

17. The image forming apparatus of claim 12, wherein:

the body includes a supporting frame at which the transporting guide is movably supported, the supporting frame includes a pair of guide protrusions that guide movements of the transporting guide, and the transporting guide includes a guide hole at each of the both sides of the transporting guide and extending in a moving direction of the transporting guide, that accommodate the guide protrusions at an inner side thereof.

18. The image forming apparatus of claim 17, wherein:

the body comprises:

an opening provided at one side thereof, and a cover to open/close the opening, wherein the supporting frame is disposed at an inner side of the cover.

19. The image forming apparatus of claim 12, wherein:

the transporting guide is positioned at the first position before the front end of the printing medium enters into the fusing unit, and is moved from the first position to the second position when the front end of the printing medium enters into the fusing unit.

20. The image forming apparatus of claim 19, wherein:

the transporting guide is moved from the second position to the first position when a rear end of the printing medium is passed through the transferring apparatus.

21. The image forming apparatus of claim 12, further comprising:

a static removing member that removes static electricity of the printing medium being transported toward the fusing unit, and the static removing member is installed at the transporting guide and moves along with the transporting guide.

22. The image forming apparatus of claim 20, wherein:

the static removing member is positioned at the first position before the front end of the printing medium is entered into the fusing unit, and is moved from the first position to the second position when the front end of the printing medium is entered into the fusing unit.

23. The image forming apparatus of claim 22, wherein:

the static removing member is moved from the second position to the first position when the rear end of the printing medium is passed through the transferring apparatus.

24. The image forming apparatus of claim 1, wherein the plurality of fusing rollers are a pair of fusing rollers.

25. The image forming apparatus of claim 1, wherein the transporting guide is movably installed to move between the first position to guide a front end of the printing medium and the second position spaced apart by the predetermined distance from the first position.

* * * * *